United States Patent [19]

Quinn

[11] 4,119,907

[45] Oct. 10, 1978

[54] POWER FACTOR CORRECTOR FOR A RESISTIVE LOAD

[75] Inventor: Halsey P. Quinn, Rancho Palos Verdes, Calif.

[73] Assignee: Xerox Corporation, Stamford, Conn.

[21] Appl. No.: 801,183

[22] Filed: May 27, 1977

[51] Int. Cl.[2] ..... G05F 1/68

[52] U.S. Cl. ..... 323/105; 323/20; 323/106; 323/119; 363/89

[58] Field of Search ..... 323/21, 101, 102, 105, 323/106, 119, 121, 20; 363/41, 81, 84, 89

[56] References Cited

U.S. PATENT DOCUMENTS

| | | | |
|---|---|---|---|
| 3,846,692 | 11/1974 | Hill | 363/84 |
| 4,038,594 | 7/1977 | Quinn et al. | 323/21 |

FOREIGN PATENT DOCUMENTS

| | | | |
|---|---|---|---|
| 2,513,168 | 9/1976 | Fed. Rep. of Germany | 323/106 |

*Primary Examiner*—Gerald Goldberg

*Attorney, Agent, or Firm*—James J. Ralabate; Sheldon F. Raizes; Leonard Zalman

[57] ABSTRACT

An apparatus for substantially eliminating the effects of a nonsinusoidal current from a reactive or nonlinear load as applied to a resistive load requiring an input current that appears to be sinusoidal. If the amplitude of the current source as applied to the resistive load can be controlled through a switching regulator by matching a sine wave reference signal with current inputed from the current source then said input current may be forced into a sinusoidal mode that is in phase with the voltage thereof. Accordingly, with the input current in a phased sinusoidal condition, harmonic elimination and power factor correction may be afforded to the inputed power relative to the resistive load.

1 Claim, 5 Drawing Figures

POWER FACTOR CORRECTOR FOR A RESISTIVE LOAD

BACKGROUND OF THE INVENTION

A. Field of the Invention

This invention relates to the field of power supplies having reactive or nonlinear loads and fuser heater elements in a xerographic copier, and more particularly to a power factor correction apparatus for use in such power supplies.

B. Description of the Prior Art

In the past, low voltage DC supplies for logic and high voltage supplies for xerographic processes would require input filters which were usually large inductors designed to minimize effects on line power factor. Such large inductors were expensive as to initial installation and also as to ongoing maintenance in addition to being spatially unwieldy. As such, there was a need to reduce or eliminate the inductors and substitute therefor alternative means to correct the power factor. Particularly, there was a need to replace such inductors with a relatively large resistive regulated load as might already exist in a machine for other purposes thereby using its input characteristics to provide power factor compensation.

SUMMARY OF THE INVENTION

It is an important object of the invention to improve the input power factor of a copier machine to thereby minimize the input current requirements.

It is another object of the invention to provide a means for replacing the present large input inductors for DC supplies.

BRIEF DESCRIPTION OF THE DRAWINGS

Various other objects, advantages and meritorious features of the invention will become more fully apparent from the following specification, appended claims and accompanying drawing sheets. The features of the specific embodiment of the invention are illustrated in the drawings in which:

DETAILED DESCRIPTION OF THE PREFERRED EMBODIMENT

Figure 1:
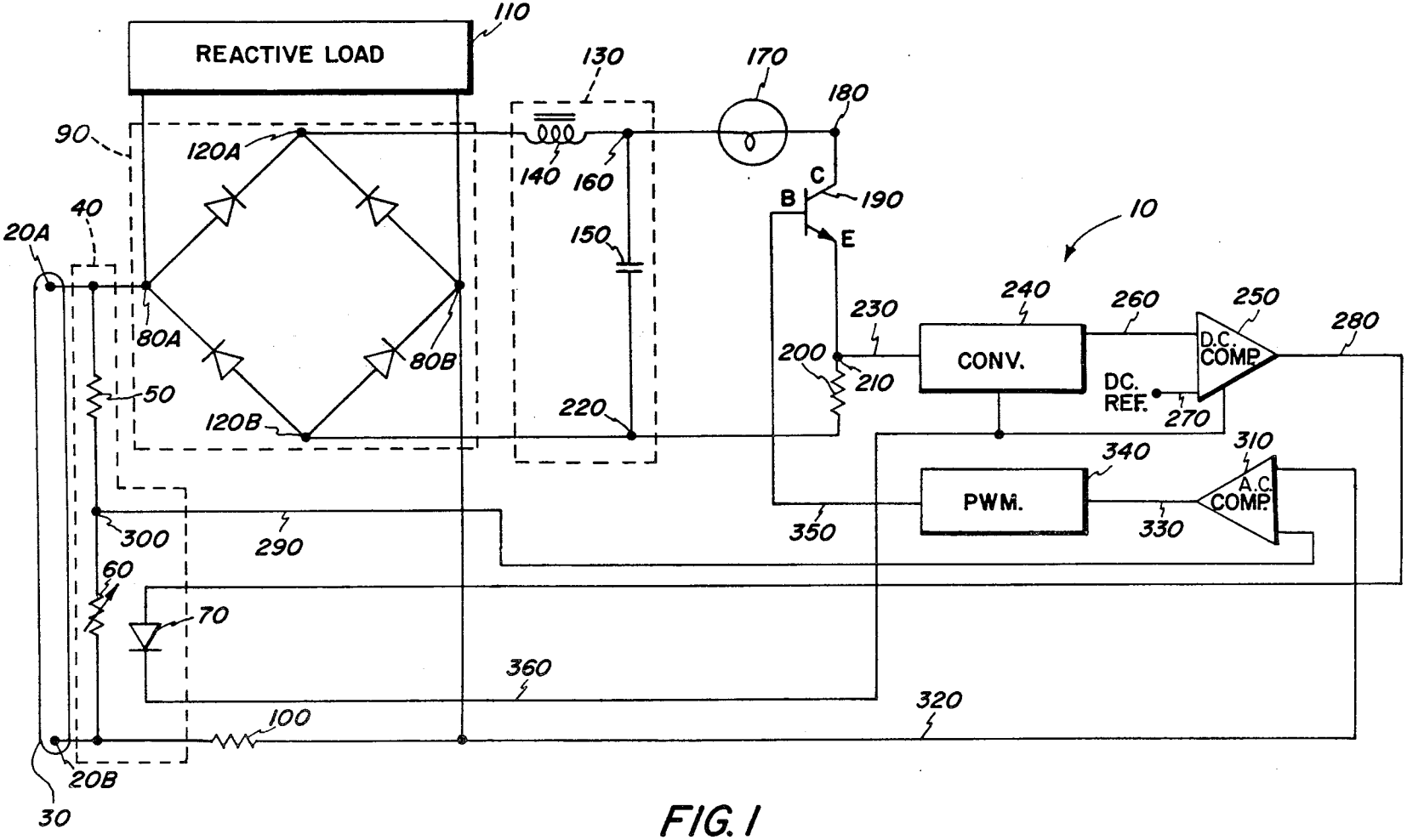
FIG. 1 is a schematic diagram of the power factor corrector in a power supply having a reactive load; and FIGS. *2a–2d* are waveforms illustrating the operation of the power factor corrector in the power supply having a reactive load.

Referring generally to FIGS. 1 through *2a–d* by the characters of reference, there is illustrated a power factor correcting apparatus 10 for carrying out the objects of the invention.

Referring particularly to FIG. 1 in regards to the schematic description, alternating line current (115 VAC) is received from a source (not shown) at terminal set 20A and 20B of input port 30. The received potential is applied across an input resistive divider 40 having a fixed resistor 50 of 10KΩ and a variable resistor 60 of 270Ω. The variable resistor 60 is preferably a light dependent resistor having a light-emitting diode 70 operatively connected thereto as will be seen infra. The input resistive divider 40 is connected across the input terminals 80A and 80B of a diode bridge 90 that full-wave rectifies. Interposed between input terminal 80B of the bridge 90 and terminal 20B of the input port 30 is a current sensing resistor 100 of 3Ω as will be described infra. An impedance load 110 having reactive components that can be nonsinusoidal is also placed across the input terminals 80A and 80B of the full-wave diode bridge rectifier 90. Output terminals 120A and 120B of the bridge 90 present a unidirectional or pulsating quasi DC signal to a filter 130 having magnetic and capacitive components. Particularly, the filter 130 is a L-shaped unit having a fixed inductor 140 of 100uhy in an arm and a fixed capacitor 150 of 7uf in its leg. The LC filter 130 is operative to smooth out the ripples and otherwise limit the amplitude of the disturbances to the input power line received at port 30 as will be further described infra. The voltage from the LC unit 130 is next presented through terminal 150 to a relatively large resistive or energy absorbing load 170 that is radiative including heat or light such as an incandescent lamp or fuser heater element for a xerographic copier. It will be appreciated that the energy absorbing load 170 may also be a battery or motor. Received at a terminal 180 of the load 170 is the collector (C) of a switching NPN transistor 190 used as a chopper as herein described, It will be noted that the switching transistor is operative to transfer a non-inductive load such as load 170 thereby simplifying transistor 190 selection. A dropping resistor 200 of 0.1Ω used as a sampler for current or voltage sensing, as infra described, is provided through a terminal 210 to the emitter (E) of the switching transistor 190. The resistor 200 has its opposite end operatively connected through a terminal 220 to the LC filter unit 130. Interposed between the dropping resistor 200 and the emitter (E) terminal of the switching transistor is a signal line 230 having its source at the supra-mentioned terminal 210 and is operative to feed off to an RMS-to-DC converter 240 of conventional design. The converter 240, in turn, is operative to output a predetermined DC signal to a DC comparator 250 using an OP Amp. Model MC1458 of conventional design through line 260. In addition, the DC comparator 250 is disposed to also receive a DC reference signal of 1V on line 270 from a predetermined internal or DC battery source (not shown). The differential output of the DC comparator 250 will then proceed on a line 280 to the anode of the light-emitting diode 70 for correcting adjustment of the variable light dependent resistor 60 of the input resistive divider 40 as will be further explained infra.

Interposed between fixed resistor 50 and variable or light dependent resistor 60 is a first signal line 290 originating from a terminal 300 for transmittal as an input to an AC comparator 310 using an OP Amp. Model R-301 of Intronics of conventional design. In addition, a second signal line 320 originates from the input terminal 80B of the full-wave diode bridge 90 and which is also common to the output of the current sensing resistor 100 for inputting also to the AC comparator 310 mentioned supra. Upon receipt of the above-mentioned signals, the AC comparator 310, as will be detailed infra, will output a control signal on line 330 to a pulse width or duration modulator 340 as described in Patent Application No. 801,182, entitled Pulse Width Modulator System for modulating a train of pulses generated therein as will be also detailed infra. The modulator 340 may be frequency or pulse width modulated or both but in the preferred embodiment pulse width modulated. The pulsing signals are operative to be outputed by the pulse width modulator 340 on line 350 to the base (B) terminal of the switching transistor 190 for the turning on-and-off thereof. Common relative ground is provided to the cathode terminal of the light-emitting diode 70, the ground terminal of the DC converter 240, and the ground terminal of the DC comparator 250 through an interconnected ground line 360.

In regards to the operative description at the system level, as shown in FIGS. 1 and 2*a–d*, the pulse width modulator or regulator 340 is used to regulate the relatively large resistive load 170 such as an incandescent lamp or fuser heater in a xerographic copier. Reactive or other loads 110 in the copier machine use capacitive input filters which draw current only from a small portion of each cycle and inductive loads which cause a lagging power factor. This circuit or apparatus 10 of the present invention senses through resistor 100 total current into all loads 40 and 110 and forces current through the relatively large resistive load 170 to complement the current in the other or reactive loads 110 in such a way that the sum of all currents will be a wave of the same shape and phase as the input voltage at terminals 20A and B of input port 30. Thus, accordingly, a unity power factor may be produced with a very small harmonic content as received by the relatively large resistive load 170.

As part of a more fully developed system description of the above, it will be noted that total line current into the resistive input 40 plus the nonsinusoidal or reactive load 110 is sensed through resistor 100. In addition, it is used to control the current waveshape into the relatively large resistive load 170 in such a way that the current to the resistive input 40 plus the reactive load 110 will add up to a waveshape that is similar to the input voltage waveshape at terminals 20A and B of the input port 30 and in phase therewith. This is accomplished by referencing the input voltage through lines 290 and 320 and controlling the pulse width modulator 340 which is operative, in turn, to control a chopper or switching transistor 190 in series with the relatively large resistive load 170. The instantaneous value of line current can be made to complement the nonsinusoidal current from the reactive or nonlinear load 110. Particularly, the RMS voltage in the relatively large resistive load 170 may then be transformed at convertor 240 to DC for comparison at 250 with a DC reference on line 270. This comparator 250 will then be operative to adjust the level of the current through light-emitting diode 70 and therefor adjust the light-dependent resistor 60 of the resistive input 40 so that the level of RMS current at the relatively large resistive load 170 will remain relatively constant through time.

Figure 2A:
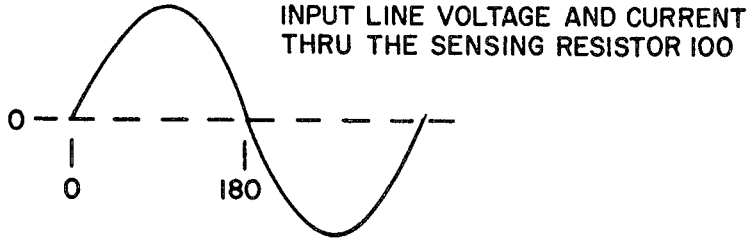
Figure 2B:
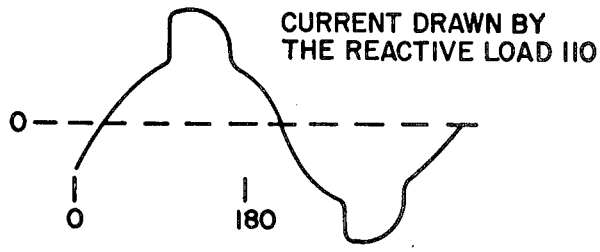
Figure 2C:
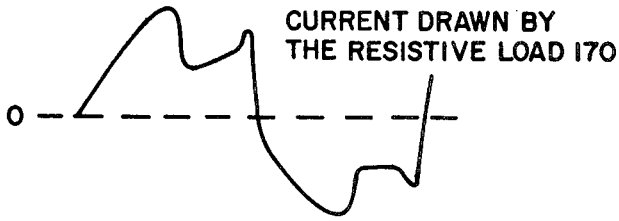

In a detailed description of the operation of the apparatus 10 at the component level, it will be seen that it is possible to mask the nonsinusoidal loading of the capacitive input rectifiers and phase displaced low power factor inductors of the reactive load 110 as shown in FIG. 2*b*. To accomplish the above, it is preconditioned that the relatively large resistive load 170, such as a fuser heater element, to be regulated must be relatively larger than the reactive load 110. Particularly, the pulse width modulator 340 must be operative to pulse the switching transistor 190 to control current in the relatively large resistive load 170 as shown in FIG. 2*c*. Resistor 200 will sample the resistive load 170 current which is then converted to DC at 240 and fed to the comparator 250 for comparison with the DC reference on line 270. The differential error between these two supra signals will be amplified by the same comparator 250 and used to control a resistive divider or resistive input 40, which may also have capacitive or inductive elements, to provide a referenced AC signal on line 290 to a second comparator 310.

Figure 2D:
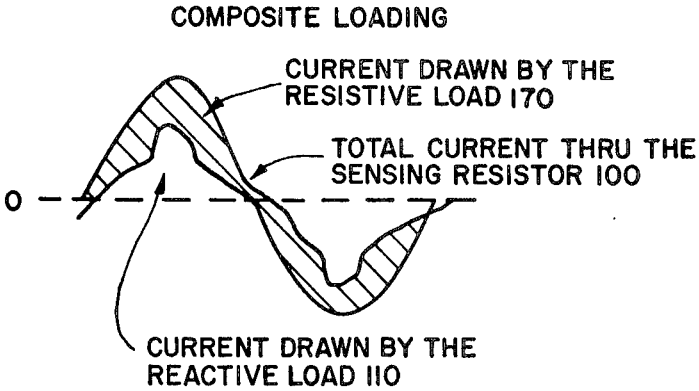

The sensing resistor 100, as shown in FIG. 2*a*, will sample input current which will be fed to the second comparator 310. Comparator 310 will then amplify the differential between the current sampled and the AC reference for adjusting the input to the pulse width modulator 340 in such a scaler direction as to cause the pulse width to increase or decrease the current through the switching transistor 190 and the series connected relatively large risistive load 170. That is to say that the pulse width may change within any given one cycle to obtain complementary distortion. Acordingly, the distortion induced into the resistive load 170 will cancel that existing in the reactive load 110 thereby eliminating the voltage-current phase difference and obtaining *a* power factor of unity as seen at the input terminals 20A–B. Because the load of the sensing resistor 100 is relatively purely resistive, it will not matter what the current waveshape may be as long as the RMS value is correct. Therefore, if the reactive load 110 is out of phase with the voltage, the current through the resistive load 170 may be made to complement the odd out-of-sync currents, and, accordingly, force the line current in sensing resistor 100 into the same shape as the input voltage thereby being in phase therewith relative to the input voltage as shown in FIG. 2*d*. The result of the foregoing will be to produce resistive loading having a power factor approaching unity as to the line thereby obtaining a relatively acceptable level of harmonic content and DC components as to the input current through time.

From the foregoing description of a specific apparatus illustrating the terminal features of the invention, it will now be apparent to those skilled in the art that the invention may be constructed in a variety of forms without departing from the true spirit and scope thereof. Accordingly, it is to be understood that the illustrated apparatus disclosed herein is a preferred embodiment of the invention and that the invention is not to be limited thereby, but only by the appended claims.

What is claimed is:

1. A correcting circuit for compensating the power factor of a signal due to reactive loading comprising:

(a) alternating current rectification means having an input side and an output side, said input side of said rectification means receiving an alternating current signal whereby said rectification means produces at its output side a unidirectional power signal;

(b) a resistive input circuit connected across said input side of said rectification means;

(c) a resistive load coupled to said output side of said rectification means for receiving said unidirectional power signal;

(d) first comparator means coupled to said resistive load for comparing the amplitude of the signal through said resistive load with a reference signal and for generating a first control signal having an amplitude indicative of any difference between the amplitude of said signal through said resistive load and said reference signal;

(e) means coupled to said first comparator means and operatively associated with said resistive input circuit for changing the resistance of said resistive input circuit as a function of the amplitude of said first control signal;

(f) second comparator means coupled to said input side of said alternating current rectification means and coupled to a point of said resistive input circuit for generating a second control signal indicative of the difference between the alternating current signal supplied thereto from said input side of said alternating current rectification means and the alternating current signal supplied thereto from said point of said resistive input circuit; and (g) means coupled to said second comparator means and to said resistive load for regulating the magnitude of said unidirectional power signal through said resistive load to thereby provide power factor correction.

* * * * *